US012158284B2

(12) United States Patent
Sixsmith

(10) Patent No.: US 12,158,284 B2
(45) Date of Patent: Dec. 3, 2024

(54) WINDBAND SILENCER WITH MEANS TO REDUCE CROSS-WIND PRESSURE DIFFERENTIAL

(71) Applicant: Plasticair Inc., Mississauga (CA)

(72) Inventor: Paul Sixsmith, Toronto (CA)

(73) Assignee: Plasticair Inc., Mississauga (CA)

( * ) Notice: Subject to any disclaimer, the term of this patent is extended or adjusted under 35 U.S.C. 154(b) by 0 days.

(21) Appl. No.: 17/563,390

(22) Filed: Dec. 28, 2021

(65) Prior Publication Data

US 2022/0120457 A1 Apr. 21, 2022

Related U.S. Application Data

(63) Continuation of application No. 16/249,309, filed on Jan. 16, 2019, now Pat. No. 11,236,914.

(60) Provisional application No. 62/617,664, filed on Jan. 16, 2018.

(51) Int. Cl.

| | |
|---|---|
| ***F24F 13/24*** | (2006.01) |
| ***F24F 7/02*** | (2006.01) |
| *F24F 7/00* | (2021.01) |

(52) U.S. Cl.

CPC ..... *F24F 7/02* (2013.01); *F24F 7/025* (2013.01); *F24F 13/24* (2013.01); *F24F 2007/001* (2013.01); *F24F 2013/242* (2013.01)

(58) Field of Classification Search

CPC .... F24F 7/02; F24F 7/025; F24F 13/24; F24F 2007/001; F24F 2013/242

USPC ..... 454/39

See application file for complete search history.

(56) References Cited

U.S. PATENT DOCUMENTS

| | | | | | |
|---|---|---|---|---|---|
| 2,811,095 | A * | 10/1957 | Moran | F24C 15/002 | 126/307 R |
| 2,841,071 | A * | 7/1958 | Strawsine | F23J 11/04 | 126/307 R |
| 3,307,337 | A * | 3/1967 | Freitas, Jr. | F23J 15/022 | 55/505 |
| 3,385,197 | A * | 5/1968 | Greber | F28C 1/00 | 261/DIG. 11 |
| 4,466,340 | A * | 8/1984 | Briner | F23J 13/025 | 454/36 |
| 4,608,963 | A * | 9/1986 | Townsend | F23J 13/025 | 126/307 R |
| 5,234,582 | A * | 8/1993 | Savoie | E04D 13/0409 | 52/12 |

(Continued)

*Primary Examiner* — Avinash A Savani
*Assistant Examiner* — Ryan L Faulkner
(74) *Attorney, Agent, or Firm* — Oathout Law Firm; Elizabeth Gray; Mark A. Oathout

(57) ABSTRACT

A windband for an exhaust fan system. The windband comprises an elongate housing receivable about an exit nozzle of the exhaust fan system, an air inducer formed from a perforated material and positioned adjacent the bottom portion of the elongate housing, and a discharge sleeve positioned adjacent and secured to the top portion of the elongate housing. The discharge sleeve is formed from a perforated material and forms a passageway through which gas from the nozzle and induced ambient air passing through the elongate housing are discharged. The perforated air inducer and discharge sleeve together assist in the minimization of a pressure differential between an upwind side of the windband and a downwind side of the windband when the windband is subjected to wind striking the windband at an angle.

5 Claims, 5 Drawing Sheets

(56) References Cited

U.S. PATENT DOCUMENTS

| | | | | |
|---|---|---|---|---|
| 8,579,074 | B2 * | 11/2013 | Kosaka | F02C 7/045 181/224 |
| 8,647,182 | B2 * | 2/2014 | Enzenroth | B08B 15/02 454/16 |
| 8,758,101 | B2 * | 6/2014 | Khalitov | F04D 17/06 454/339 |
| 9,057,519 | B1 * | 6/2015 | Paynton | F23L 17/12 |
| 2002/0125068 | A1 * | 9/2002 | Barry | F24F 7/02 181/224 |
| 2003/0192737 | A1 * | 10/2003 | Han | F28F 9/0263 181/224 |
| 2008/0207105 | A1 * | 8/2008 | Huta | F23L 17/02 454/4 |
| 2012/0292407 | A1 * | 11/2012 | Mornan | F24F 13/26 239/461 |
| 2016/0060873 | A1 * | 3/2016 | Sugatani | F16L 11/15 29/401.1 |
| 2019/0154284 | A1 * | 5/2019 | Teoh | F24F 11/0001 |
| 2022/0354225 | A1 * | 11/2022 | Berruex | A44C 9/0023 |

* cited by examiner

WINDBAND SILENCER WITH MEANS TO REDUCE CROSS-WIND PRESSURE DIFFERENTIAL

FIELD

This invention relates generally to the field of exhaust fans and exhaust ducts for such fans.

BACKGROUND

Exhaust fans are commonly used to exhaust or remove noxious gases from buildings and the like. Typically, fume hoods are used to capture exhaust gases at or near their source. A duct and fan system then draws the noxious gases from the fume hood and expels them into an exterior environment. In many cases it is desirable to exhaust the gases at a higher elevation to help ensure that the gases do not persist at lower altitudes where they may cause irritation or damage to humans, animals, plant life or objects.

Traditionally tall exhaust stacks have been utilized to deliver exhaust gases at an altitude to ensure their dilution within ambient air to the point that any noxious gas finding its way back down to lower altitudes would be substantially devoid of any deleterious effects. For a variety of apparent reasons, tall exhaust stacks suffer from a number of different limitations or disadvantages.

More recently, upblast fans, which exhaust gases at a high velocity through a nozzle in a relatively short stack, have been used to replace more traditional tall exhaust stacks. Commonly such fans are mounted on the roof of a building or structure and provide a high velocity jet of gas that is expelled upwardly into the atmosphere. The significant velocity of the gas permits it to achieve a sufficient altitude to provide for a dilution of the gas with ambient air at elevation. In many instances a wind band is utilized to inject or entrain atmospheric air within the high velocity jet of exhaust gas to further mix ambient air with the exhaust, and to dilute the effects of any noxious components.

While such upblast fans and windbands have been successfully used to exhaust noxious gas and to dilute it with ambient air, expelling a jet of high velocity exhaust gas can often generate significant levels of noise which can be undesirable, particularly in populated areas. Others have thus proposed the use of acoustic silencers for mounting about, or to be incorporated within, the nozzle of an upblast fan. While such devices can help to reduce the overall noise that is produced, their extension into the atmosphere above the fan can create a back pressure or vortex phenomenon under certain conditions. That is, as wind blows against the side of a stack or windband, the ambient air that is immediately downstream of the stack tends to exhibit a low pressure phenomenon which can create a vortex, a swirling effect or downwash effect. In such an instance the low pressure can have the effect of reducing the amount of air that is induced or drawn into the windband, having an overall negative effect upon the performance of the exhaust system through a reduction of the addition of dilution air and the creation of turbulent flow. Under certain atmospheric and wind conditions, the pressure differential between the upstream and downstream sides of the windband can be significant, as can be the vortex created. Such vortexes can also potentially lead to the drawing of noxious gases back down to ground level without mixing and dilution to a sufficient degree to minimize their noxious effects.

SUMMARY

In one aspect the invention provides a windband for an exhaust fan system, the windband comprising an elongate housing receivable about an exit nozzle of the exhaust fan system, the elongate housing having an inner chamber forming an exhaust flow path to receive exhaust gas that exits an open top of the nozzle, the elongate housing having a bottom portion positioned elevationally below the open top of the nozzle, and having a top portion positioned elevationally above the open top of the nozzle, an air inducer adjacent said bottom portion of said elongate housing, said air inducer formed from a perforated material and forming an annulus with the nozzle for the induction of ambient air into said inner chamber of said elongate housing, a discharge sleeve positioned adjacent and secured to said top portion of said elongate housing, said discharge sleeve formed from a perforated material and forming a passageway through which gas from the nozzle and induced ambient air passing through said inner chamber of said elongate housing are discharged, said perforated air inducer and said perforated discharge sleeve together assisting in the minimization of a pressure differential between an upwind side of said windband and a downwind side of said windband when said windband is subjected to wind striking said windband at an angle.

In another aspect the invention provides a windband for an exhaust fan system, the windband comprising an elongate housing receivable about an exit nozzle of the exhaust fan system, the elongate housing having an inner chamber forming an exhaust flow path to receive exhaust gas that exits an open top of the nozzle, the elongate housing having a bottom portion positioned elevationally below the open top of the nozzle, and having a top portion positioned elevationally above the open top of the nozzle, an air inducer adjacent said bottom portion of said elongate housing, said air inducer formed from a perforated material and forming an annulus with the nozzle for the induction of ambient air into said inner chamber of said elongate housing, a discharge sleeve positioned adjacent and secured to a right angle cylindrical section forming said top portion of said elongate housing, said discharge sleeve formed from a perforated material and forming a passageway through which gas from the nozzle and induced ambient air passing through said inner chamber of said elongate housing are discharged, said perforated air inducer and said perforated discharge sleeve together assisting in the minimization of a pressure differential between an upwind side of said windband and a downwind side of said windband when said windband is subjected to wind striking said windband at an angle.

In a further embodiment there is provided a windband for an exhaust fan system, the windband comprising a vertically orientated elongate housing having an upper end, a lower end and a longitudinal passageway connecting the upper and low ends, the lower end receivable about an exit nozzle of the exhaust fan system, the upper end being open to the atmosphere in a vertical direction such that high velocity exhaust gas exiting the exit nozzle passes through the lower end, through the longitudinal passageway, through the open upper end and is expelled vertically upward at a velocity that permits the exhaust gas to reach a desired altitude before significantly diluting with the surrounding atmosphere, an air inducer secured to the lower end of the elongate housing, the air inducer forming an annulus with the exit nozzle for the induction of ambient air into the longitudinal passageway when high velocity gas exits the exit nozzle and passes through the lower end of the elongate housing, and a discharge sleeve circumferentially mounted about, and exterior to, the elongate housing at the upper end, the discharge sleeve formed from a perforated material with perforations extending from an exterior surface to an interior surface of the discharge sleeve, wherein the perforations of the discharge sleeve assist in the minimization of a pressure differential between an upwind side of the windband and a downwind side of the windband when the windband is subjected to wind having a horizontal component, thereby helping to minimize a reduction in the velocity of and/or the disruption of a laminar flow of exhaust gas expelled through the open upper end caused by turbulent flow conditions that result from pressure differentials formed by the horizontal component of the wind.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DESCRIPTION

The present invention may be embodied in a number of different forms. The specification and drawings that follow describe and disclose some of the specific forms of the invention.

Figure 1:
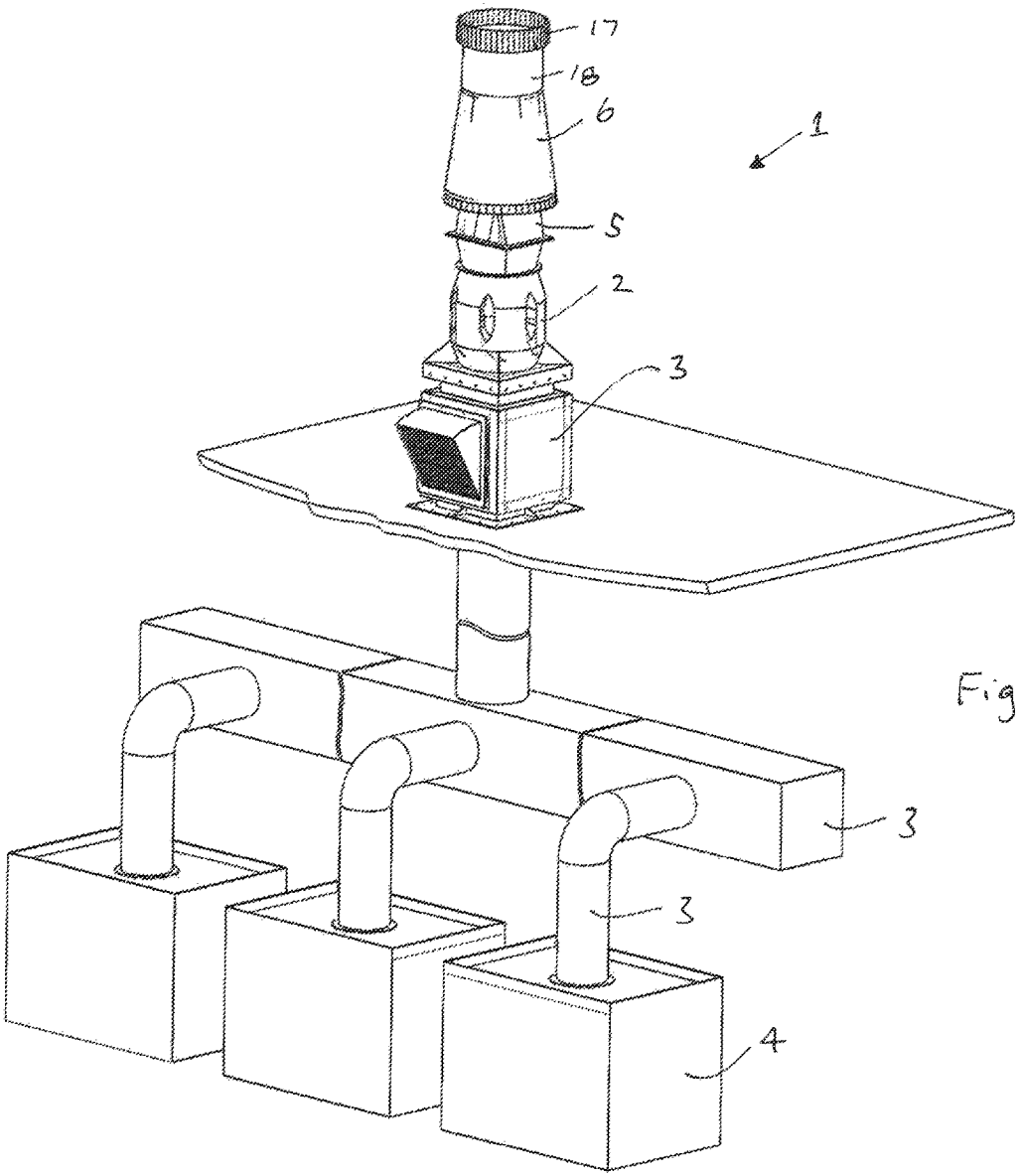
FIG. 1 is a schematic perspective view of a building ventilation system utilizing an upblast fan and incorporating an embodiment of the windband silencer of the present invention.
Figure 4:
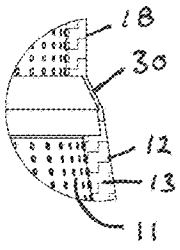
FIG. 4 is an enlarged detail view of portion A of FIG. 3.

FIG. 1 is a schematic view of a generic building ventilation system, referenced generally by numeral 1. Ventilation system 1 includes a fan 2 that draws gases through a series of ducts 3 connected to one or more fume hoods 4. It will be appreciated that depending upon the particular application at hand, the fume hoods may be associated with particular pieces of machinery, particular operations within a manufacturing facility, or otherwise associated with sources of noxious gas. Commonly, fan 2 would be mounted on the roof of the associated building and would exhaust gases drawn through ducts 3 vertically upward through an exit nozzle 5. A windband 6, constructed in accordance with an embodiment of the invention, is positioned about nozzle 5. As in the case of traditional upblast fans, gases and air exiting windband 6 are expelled upwardly at a sufficient velocity to permit them to be diluted with ambient air at an elevation, and to minimize their adverse effects closer to the building or ground surface.

With specific reference to FIGS. 2 through 5, there is shown a preferred embodiment of the structure of windband 6. Windband 6 is generally comprised of an elongate housing 7 that is received about nozzle 5. In the embodiment shown, housing 7 has a lower or bottom portion 8 and an upper or top portion 9. Bottom portion 8 has a generally upright conical configuration and is positioned below the upper end of nozzle 5 with top portion 9 positioned elevationally above the upper end of nozzle 5. In addition, in a preferred embodiment of the invention elongate housing 7 is generally circular in cross section, having a cross sectional diameter at bottom portion 8 exceeding that at top portion 9.

Elongate housing 7 includes a side wall 10 that extends between bottom portion 8 and top portion 9, and that generally defines a hollow inner chamber or passageway through which exhaust gas and induced air flows and is expelled in an upward direction, much like traditional windbands. Sidewall 10 may be comprised of an inner wall portion 11 spaced apart from an outer wall portion 12. To help minimize sound transmission through elongate housing 7, an acoustic absorbing material 13 may be inserted in the space between inner wall 11 and outer wall 12. The particular acoustic material that is utilized could vary from application to application, and the temperature and environmental factors to which windband 6 may be exposed. In most instances it is expected that acoustic material 13 will be comprised of steel, steel or mineral wool, fibreglass, rigid or semi-rigid foam, or plastic. To further help minimize the transmission of sound through the elongate housing, and to enhance its sound dampening effect, inner wall 11 of elongate housing 7 may be entirely or substantially constructed from perforated material. Once again, depending upon the particular environment and conditions under which the windband is intended to be operated, the perforated material comprising inner wall 11 could be formed from a sound dampening material, including plastic, fibreglass and other such materials.

In accordance with the invention, windband 6 further includes an air inducer 14 positioned at bottom portion 8 of elongate housing 7. As shown in the attached drawings, and as will be appreciated by one of ordinary skill in the art having a thorough understanding of the invention, air inducer 14 could be a separate component physically secured to bottom portion 8 of elongate housing 7, it could be in essence an extension of outer wall 12, or it could be an extension of inner wall 11. In an embodiment, air inducer 14 is of a single wall construction, forming an annulus 15 with nozzle 5 for the induction of ambient air into the hollow interior of elongate housing 7. Air inducer 14 is formed from a perforated material that, as in the case of inner wall 11, could be constructed from a wide variety of different materials.

Windband 6 is mounted and secured to nozzle 5 through the use of a plurality of elongate fins 16. Fins 16 serve the further purpose of assisting in directing the flow of induced air through elongate housing 7 and helping to minimize turbulent effects. Fins 16 may also be formed from a perforated material to help reduce acoustic resonance and to minimize the production of sound as high velocity air passes over their surfaces.

Windband 6 further includes a discharge sleeve 17 located and positioned at top portion 9 of elongate housing 7. In the particular embodiment shown in the attached drawings, elongate housing 7 contains at its top or upper portion a right angle cylindrical section 18 that effectively forms a transition between the upper portion of the conical elongate housing and discharge sleeve 17. Cylindrical portion 18 may formed from a solid wall, a perforated wall, or a combination of an exterior solid wall and a perforated inner wall (with or without acoustic insulation there between). Discharge sleeve 17 is formed from a perforated material and is generally circular in cross section, creating a generally cylindrical passageway through which gas from nozzle 5 and induced ambient air drawn through annulus 15 are discharged. In one embodiment, discharge sleeve 17 may be of a diameter greater than that of cylindrical section 18 with the lower portion of discharge sleeve 17 secured to cylindrical section 18 in a manner that prohibits the induction of air between the annulus created between discharge sleeve 17 and cylindrical section 18.

Figure 3:
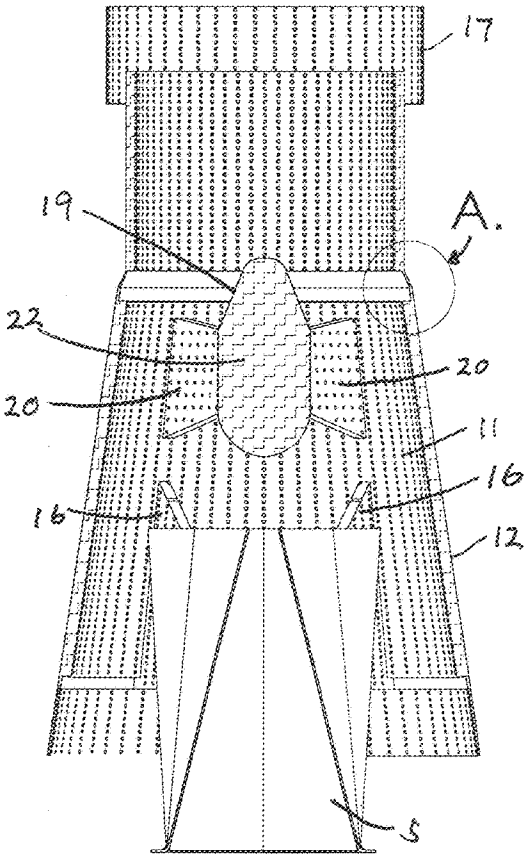
FIG. 3 is a vertical section view taken along the line A-A of FIG. 2.
Figure 2:
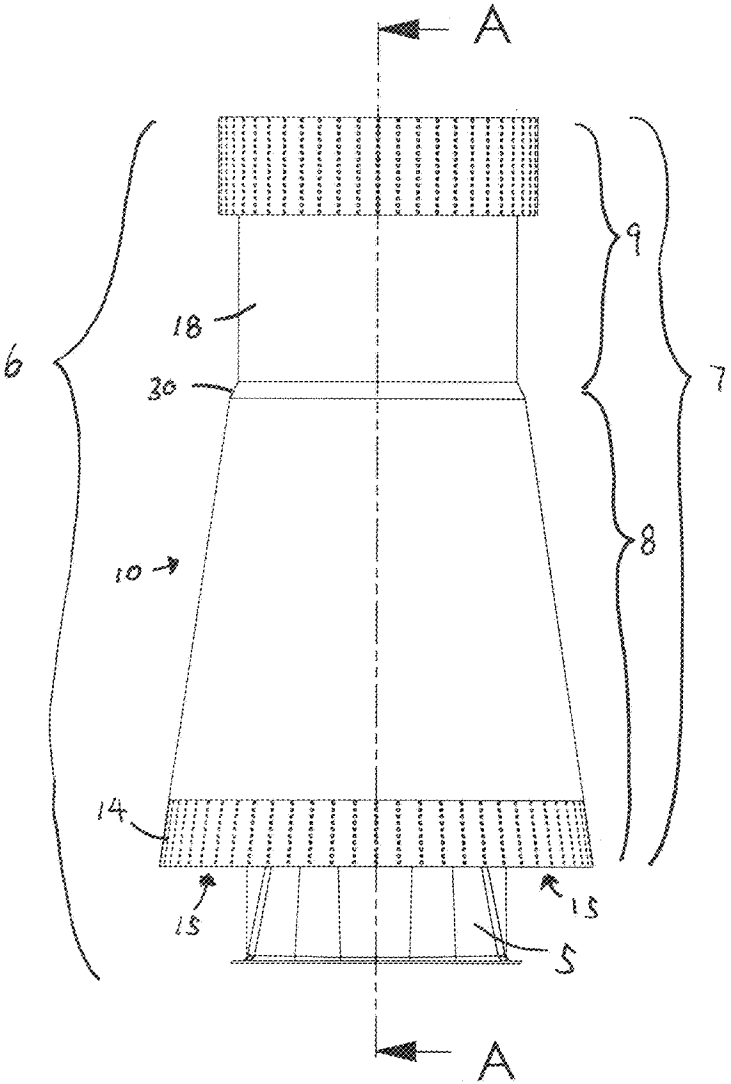
FIG. 2 is a side perspective view of the windband silencer in accordance with an embodiment of the invention.
Figure 6:
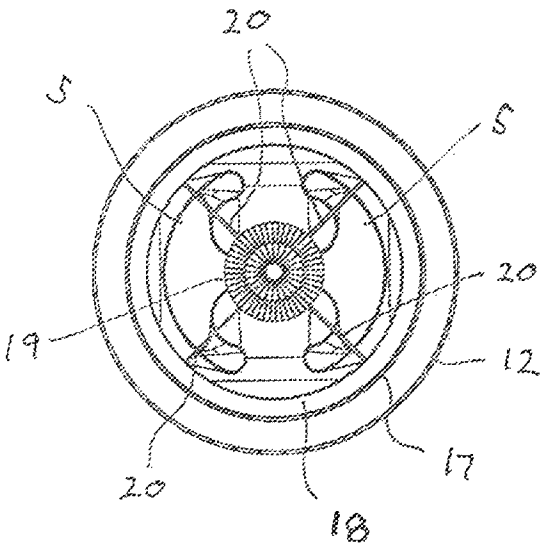
FIG. 6 is a plan view of the windband silencer shown in FIG. 2.
Figure 5:
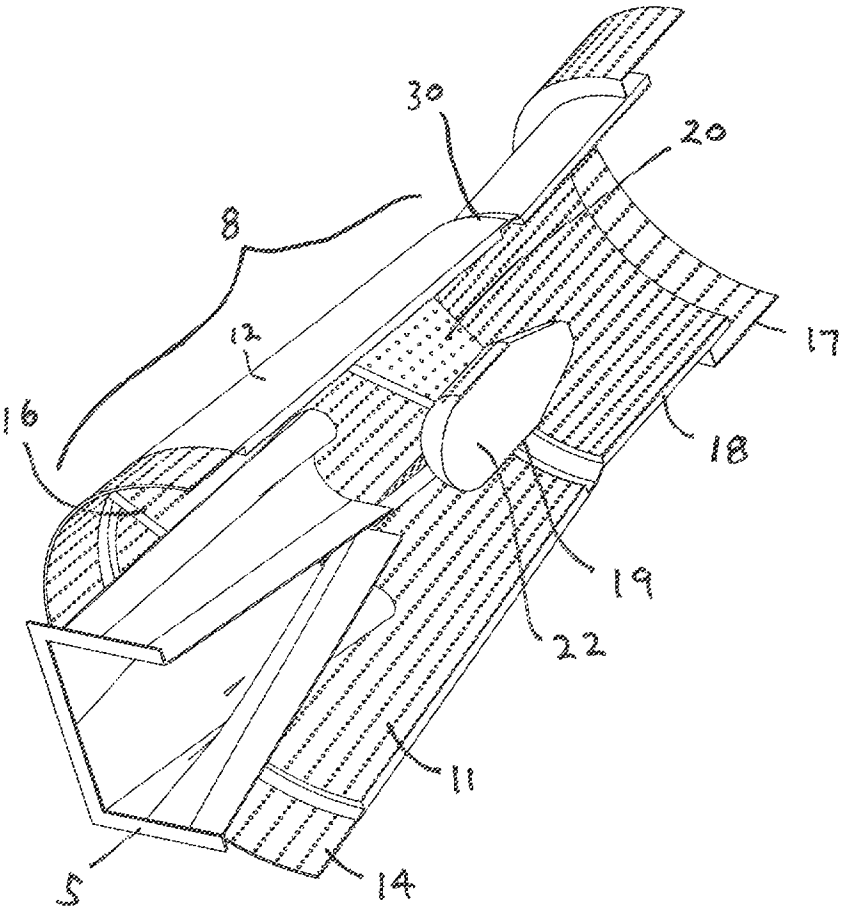
FIG. 5 is an upper side perspective view of the section shown in FIG. 3.
Figure 7A:
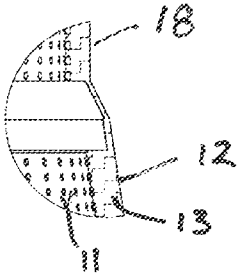
FIG. 7A is an enlarged detail view of portion A in FIG. 7.
Figure 7:
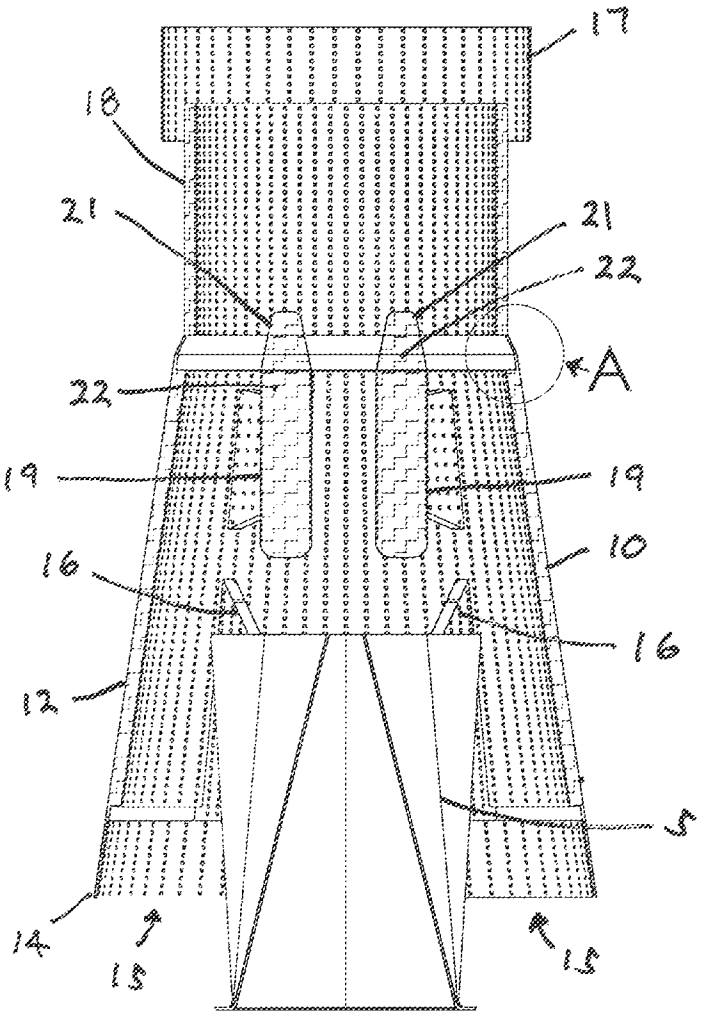
FIG. 7 is a vertical section view, similar to FIG. 3, of an alternate embodiment of the windband silencer.
Figure 9:
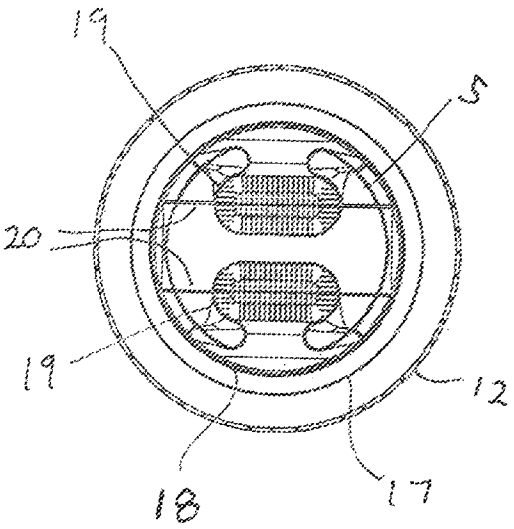
FIG. 9 is a plan view of the embodiment of FIGS. 7 and 8.
Figure 8:
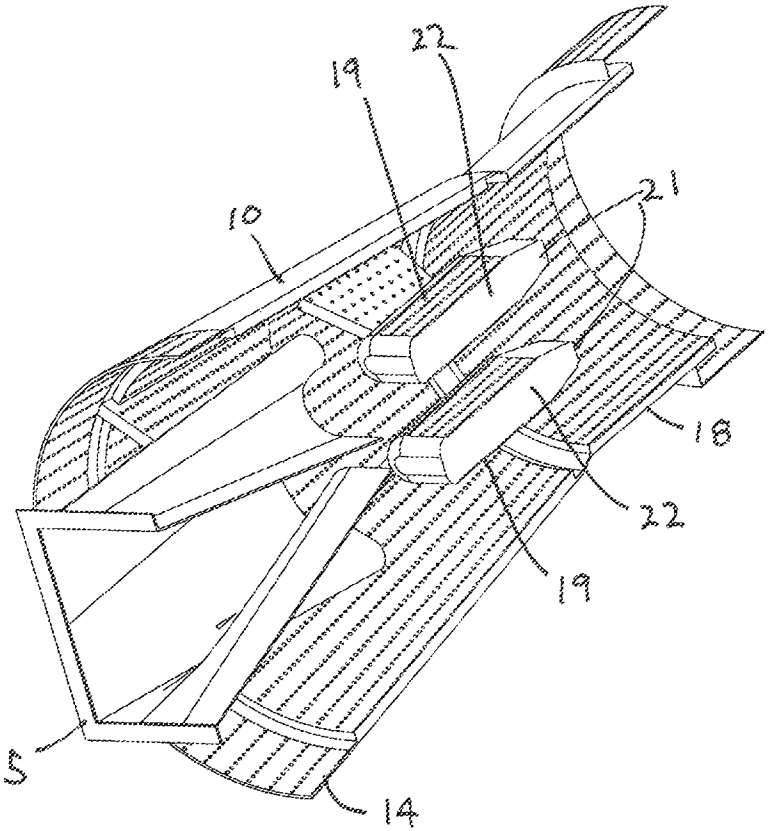
FIG. 8 is a lower side perspective view of the section shown in FIG. 7.

In some embodiments, windband 6 may, optionally, include one or more bullet style acoustic attenuators 19. FIGS. 3, 5 and 6 illustrate an embodiment utilizing a single bullet style acoustic attenuator. FIGS. 7, 8 and 9 illustrate an embodiment utilizing two bullet style acoustic attenuators. Bullet acoustic attenuators 19 are retained within, and generally parallel to, elongate body 7 through a plurality of fins 20 extending from inner wall 11 to the exterior of the bullet acoustic attenuators. Fins 20 may also extend between adjacent bullet acoustic attenuators where multiple attenuators are utilized. Fins 20 are also preferably aligned with the longitudinal axis of body 7 to minimize drag, turbulent flow, and noise generation. Further, the upper end 21 of each bullet acoustic attenuator 19 may be conical in shape and directed toward discharge sleeve 17. The conical shape of upper end 21 serves to help reduce turbulence, losses, and pressure drop, and to minimize noise generation. The exterior surface of bullet acoustic attenuation member 19 is preferably formed from a perforated material to help "deaden" sound generated by the moving stream of gas as it travels through the windband. The interior of each bullet acoustic attenuator may be filled with a sound absorbing or dampening material 22. Where two or more bullet style acoustic attenuators are used, their cross-sectional shape may be generally obround as shown in FIG. 9. In such an embodiment, the upper ends 21 of the attenuators may be generally triangular in longitudinal section with a blunted or rounded nose, as shown in FIGS. 7 and 8. Where one or more bullet acoustic attenuators are utilized, elongate body 7 may include a stepped expansion 30 to maintain the same velocity through the housing as would be the case if no bullet acoustic attenuators were present. In other embodiments portions or all of top portion 9 of elongate housing 7 may be increased in diameter to maintain velocities.

It has been discovered that utilization of a windband constructed as above assists in helping to minimize pressure drop from one side of the windband to the opposite side when the windband is subjected to a crosswind. In that regard, it will be appreciated that the portion of a building ventilation system that extends above the roof of a building or a structure is subject to the effects of wind that strikes the exterior surface of the ventilation system components at an angle (which in many cases will be generally horizontal). Wind striking the exterior components of the ventilation system (i.e. the stack) will cause the development of a low pressure system on the opposite side. As noted above, where the wind strikes a windband, there is created a low pressure zone on the opposite side that can affect the draw of ambient air into the windband, can cause turbulent flow conditions, and can cause insufficiently diluted exhaust gases to be drawn downwardly toward the building or ground. Through the use of windband 6, the extent and degree of such pressure drop is reduced. The resulting effect is that windband 6 helps to minimize any swirling or vortex on the opposite side of the windband from that struck by the prevailing wind, thereby helping to also minimize any reduction in induced air flow that can occur and a potential reduction in the diluting effects of noxious gases exhausted by the ventilation system.

It is to be understood that what has been described are the preferred embodiments of the invention. The scope of the claims should not be limited by the preferred embodiments set forth above, but should be given the broadest interpretation consistent with the description as a whole.

The invention claimed is:

1. A windband for an exhaust fan system, the windband comprising:

an elongate housing comprising a bottom portion with an upright conical configuration and a longitudinal axis, the elongate housing further having a top portion with a longitudinal axis common with that of the bottom portion, the top portion having an upper end open to the atmosphere above the windband, an air inducer comprising a lower portion of the bottom portion and forming an intake annulus with an exit nozzle of the exhaust fan system when the elongate housing is mounted about the exit nozzle, a discharge sleeve comprising a right cylinder that forms part of the top portion of the elongate housing, the top portion including a right angle cylindrical section forming a transition between the bottom portion and the discharge sleeve, the discharge sleeve having a cross sectional area larger than that of the right angle cylindrical section, and the discharge sleeve and the air inducer perforated with a series of holes about their respective circumferences, wherein the holes extend from respective outer to respective inner surfaces of the discharge sleeve and air inducer, the perforations permitting a controlled flow of air therethrough when the windband is subjected to a cross wind, wherein an annulus is formed between a lower end of the discharge sleeve and the right angle cylindrical section, the annulus enclosed to prevent an induction of air therethrough.

2. The windband as claimed in claim 1 wherein the perforations in the discharge sleeve are arranged in columns that are parallel to the longitudinal axis of the top portion.

3. The windband as claimed in claim 1 wherein the discharge sleeve is mounted to the right angled cylindrical section, wherein, when the windband is vertically oriented, a top portion of the discharge sleeve extends vertically beyond an upper end of the right angle cylindrical section.

4. The windband as claimed in claim 3 wherein the discharge sleeve comprises a bottom that extends vertically below the upper end of the right angle cylindrical section.

5. The windband as claimed in claim 4 wherein the air inducer has a diameter greater than that of the discharge sleeve.

* * * * *